US005612727A

United States Patent [19]

Morimoto et al.

[11] Patent Number: 5,612,727

[45] Date of Patent: Mar. 18, 1997

[54] PRINTER WITH PRINTHEAD PRESSURE ADJUSTING MECHANISM

[75] Inventors: Yasumasa Morimoto, Nabari; Shotaro Okamoto; Seiichi Kizu, both of Yamatokoriyama, all of Japan

[73] Assignee: Sharp Kabushiki Kaisha, Osaka, Japan

[21] Appl. No.: 631,807

[22] Filed: Apr. 12, 1996

[30] Foreign Application Priority Data

Apr. 19, 1995 [JP] Japan ..... 7-093570

[51] Int. Cl.[6] ..... B41J 25/312; B41J 25/316

[52] U.S. Cl. ..... 347/198

[58] Field of Search ..... 347/197, 198; 400/120.16, 120.17

[56] References Cited

U.S. PATENT DOCUMENTS

| | | | |
|---|---|---|---|
| 4,507,666 | 3/1985 | Kondo et al. | 347/198 |
| 5,172,137 | 12/1992 | Hongo et al. | 347/198 |
| 5,206,662 | 4/1993 | Fox et al. | 347/198 |
| 5,422,660 | 6/1995 | Oikawa | 347/198 |
| 5,448,281 | 9/1995 | Walter et al. | 347/198 |
| 5,507,582 | 4/1996 | Mistyurik | 347/197 |

FOREIGN PATENT DOCUMENTS

| | | | |
|---|---|---|---|
| 4-232087 | 8/1992 | Japan . | |
| 5-169689 | 7/1993 | Japan | 347/198 |
| 6-99642 | 4/1994 | Japan . | |
| 6-320829 | 11/1994 | Japan . | |

*Primary Examiner*—Huan H. Tran

*Attorney, Agent, or Firm*—David G. Conlin; William J. Daley, Jr.

[57] ABSTRACT

A printer with a printhead pressure adjusting mechanism including a thermal head, a platen drum, an adjusting mechanism, a detection device [e.g., switch(es)] and a control unit. The thermal head transfers ink of an ink ribbon onto recording paper by heat generation. The platen drum sandwiches the ink ribbon and the recording paper under pressure together with the thermal head. The adjusting mechanism adjusts the pressure being applied to the thermal head when pressing the thermal head. The detection device detects the size of the recording paper. The control unit controls the adjusting mechanism in order to adjust the pressure being applied to the thermal head in accordance with the detected size of the recording paper.

4 Claims, 7 Drawing Sheets

PRINTER WITH PRINTHEAD PRESSURE ADJUSTING MECHANISM

BACKGROUND OF THE INVENTION (1) Field of the Invention

The present invention relates to a printer for printing an image from a personal computer and a television receiver on recording paper.

(2) Description of the Prior Art

As a conventional printer for printing an image displayed on a CRT or the like to obtain a color hard copy, one is available in which recording paper and an ink ribbon on which a plurality of colors (three or four colors) are cyclically applied are sandwiched between a thermal head and a platen drum with a pressure, and the respective colors are transferred onto the recording paper sequentially in the overlapping manner, thereby performing recording. A conventional method of adjusting pressure applied to a head in a printer of this type will be described.

FIG. 7 is a schematic front view of a portion for adjusting pressure to be applied to a head described in Japanese Patent Application Laid-Open Hei 4 No. 232087. In FIG. 7, a rear plate 202 is arranged behind a thermal head 201. Screw holes are formed at right and left portions of the rear plate 202, and screws 205*a* and 205*b* are screwed in these screw holes, respectively. Hat-shaped movable members 204*a* and 204*b* are fitted on the distal ends of the screws 205*a* and 205*b*, and springs 203*a* and 203*b* are mounted on the periphery of the movable members 204*a* and 204*b*, thereby pressing the rear surface of the thermal head 201. Accordingly, the positions of the movable members 204*a* and 204*b* with respect to the rear plate 202 are controlled by adjusting the right and left screws 205*a* and 205*b*, so that the pressure applied at the right and left can be adjusted. This method is provided in order to decrease the difference between pressure applied at the right and left.

FIG. 8 is a front view showing an example of setting pressure to be applied to a head of another conventional printer. In FIG. 8, a rear plate 302 is arranged behind a thermal head 301, and through holes are formed in the right and left of the rear plate 302. Hat-shaped members 304*a* and 304*b* are fixed to the rear plate 302 to cover the through holes from above, and T-shaped movable members 305*a* and 305*b* and springs 303*a* and 303*b* for pressing the thermal head 301 are disposed inside the hat-shaped members 304*a* and 304*b*. The springs 303*a* and 303*b* normally push the movable members 305*a* and 305*b* toward the thermal head 301 (toward the front side). Accordingly, the T-shaped movable members 305*a* and 305*b* pressurize the thermal head 301 with the force of the springs 303*a* and 303*b*. Note that this pressurizing method is characterized in that the spring strengths are set such that the spring strength of only one side, e.g., the right side, is smaller than that of the left side due to the following reason. In a printer for conveying a plurality of recording paper sheets having different paper widths with reference to the left side, when the paper width is changed, the balance of the right and left contact pressures is changed.

FIG. 9 shows an example of a contact pressure distribution between a thermal head and a platen drum obtained when a conventional printer is used. The axis of abscissa represents the paper width, and the axis of ordinate represents the contact pressure. With recording paper of a special size (243 mm) which is equal to the width of the thermal head (referring to a solid line), the pressure distribution is uniform between its right and left portions. However, with recording paper of A4 size (210 mm) having a width smaller than that of the thermal head (referring to a dashed line), the contact pressure is increased on a side (right side) opposite to the reference (left side). Accordingly, the method of FIG. 9 is characterized in that the balance between the right and left spring pressures is intentionally changed at such a degree that will not cause a degradation in image quality even on recording paper of the special size.

However, in the conventional printers described above, regarding the right and left pressing pressures, the movable portions are adjusted with screws or the like to determine the balance between the right and left pressing pressures. With this method, the pressures cannot but be adjusted in accordance with only one setting, and the setting operation requires some time. With the method of setting the right and left spring pressures by intentionally changing them from each other so as to cope with a plurality of paper sizes, it is difficult to supply the balance of contact pressure balance appropriately for all paper widths. Therefore, a degradation in image quality, e.g., a blur at one end of an image, is caused.

SUMMARY OF THE INVENTION

It is an object of the present invention to provide a printer which detects the size of recording paper and maintains an optimal pressure for a thermal head in accordance with the detected size, so that variations in density are prevented, thereby obtaining a high printing quality.

According to one aspect of the present invention, there is provided a printer which comprises: a thermal head for transferring ink of an ink ribbon onto recording paper by heat generation; a platen drum for sandwiching the ink ribbon and the recording paper under pressure together with the thermal head; adjusting means for adjusting pressure applied to the thermal head when pressing the thermal head; detection means for detecting a size of the recording paper; and a control unit for controlling the adjusting means in order to adjust the pressure applied to the thermal head in accordance with the size of the recording paper detected by the detection means.

With the printer having the above arrangement, the size of the recording paper is detected, and the optimal pressing pressure for the thermal head is maintained in accordance with the detected size, so that variations in density are prevented, thereby providing a high printing quality.

The printer according to the present invention further comprises a cam which is driven to rotate by a pulse motor and which moves the adjusting means. The control unit outputs a predetermined number of pulses in accordance with the size of the recording paper detected by the detection means, and controls a position of the adjusting means through the cam which is rotated at a predetermined angle by the pulse motor based on the number of pulses. Thus, the rotation angle of the cam can be set precisely at any angle by controlling the number of pulses applied to the pulse motor, so that a high printing quality can be maintained with a simple arrangement.

The printer according to the present invention further comprises: a plurality of pressing means for pressing the thermal head; and origin detection means for detecting the origin which is defined as a rotation angle of the cam when the pressure of the adjusting means on the thermal head coincide with the pressure of the plurality of the pressing means on the thermal head. The control unit stops driving the pulse motor when the origin detection means detects the origin. Thus, when the rotation angle of the cam is set to the origin, position control of the adjusting means which is performed after this setting operation can be performed accurately, so that the pressing pressure on the thermal head can be set more accurately.

When the printer is not in use, the control unit outputs a predetermined number of pulses to control the pulse motor so that the rotation angle of the cam reaches the origin. As a result, deterioration of the adjusting means and the pressing means is caused by long-term use entirely to the same degree, so that unbalance in pressure caused by the long-term use can be prevented, thereby maintaining a high printing quality.

Further advantages and features of the invention as well as the scope, nature and utilization of the invention will become apparent to those skilled in the art from the description of the preferred embodiments of the invention set forth below.

DESCRIPTION OF THE PREFERRED EMBODIMENT

The preferred embodiments of the present invention will be described with reference to FIGS. 1 to 6.

Figure 1:
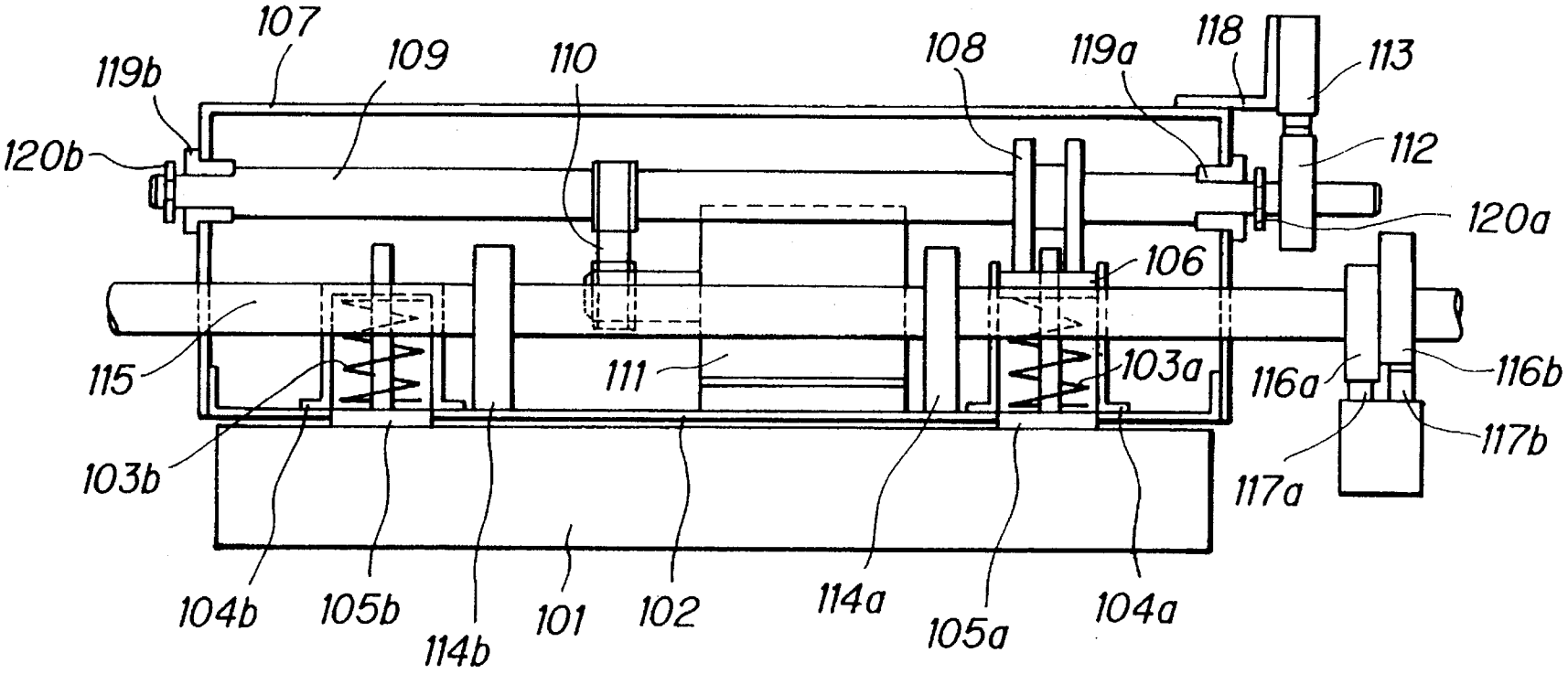
FIG. 1 is a front view showing a printer according to an embodiment of the present invention.
Figure 2:
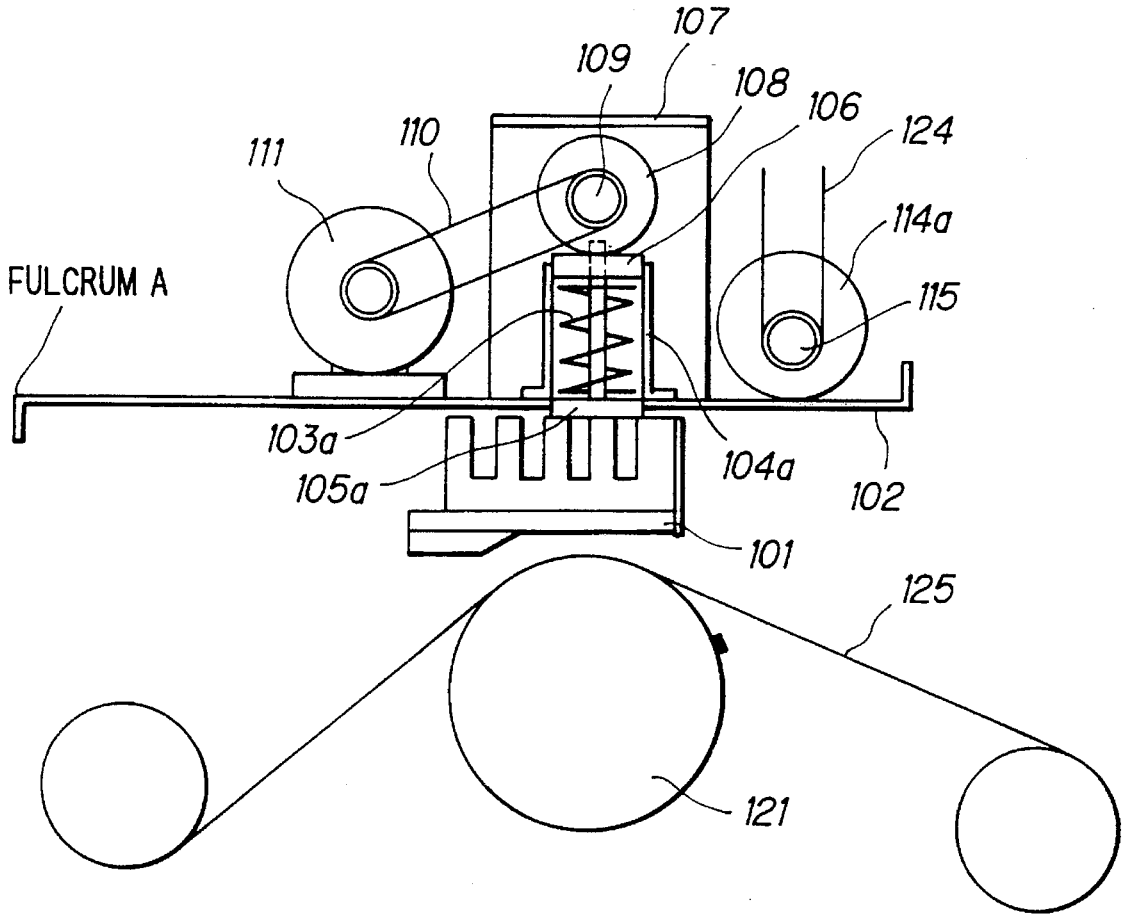
FIG. 2 is a side view of the printer shown in FIG. 1 before its head is moved downward.
Figure 3:
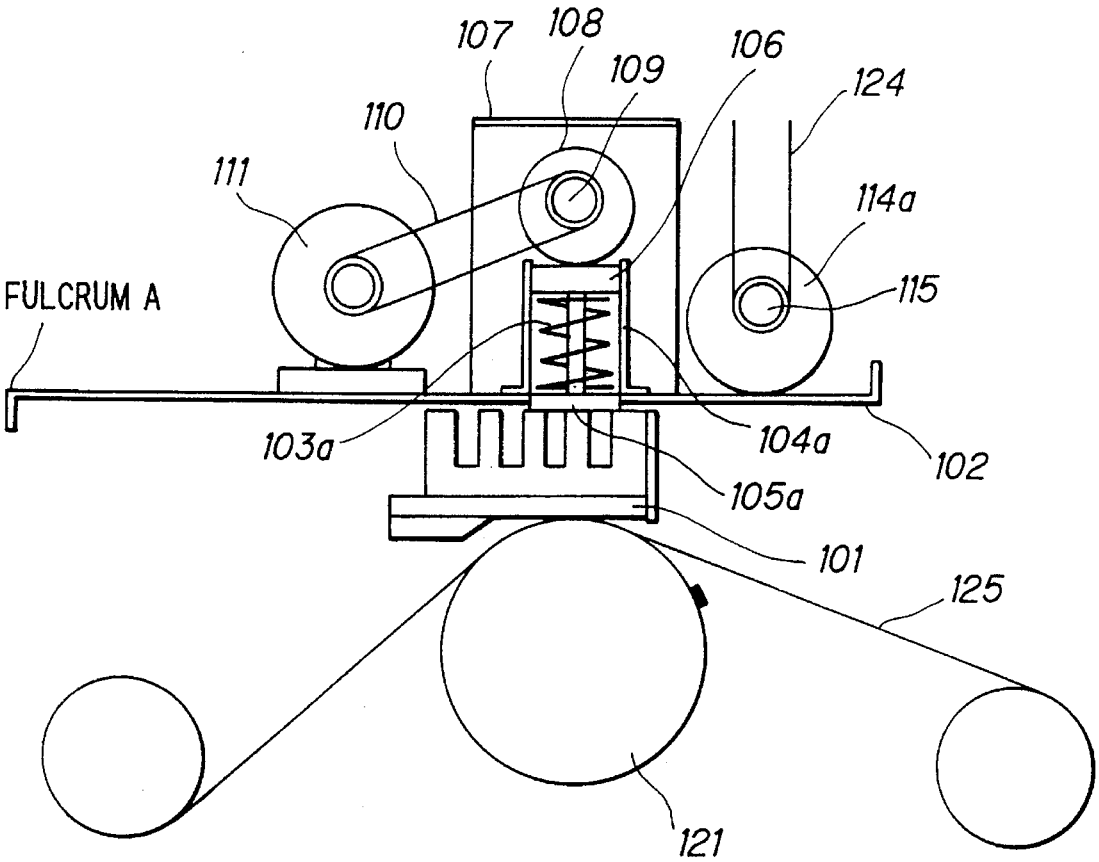
FIG. 3 is a side view of the printer shown in FIG. 1 after its head is moved downward.

FIGS. 1 to 3 are schematic views showing a printer according to an embodiment of the present invention, in which FIG. 1 is a front view showing a state wherein pressure is applied to a thermal head, and FIGS. 2 and 3 are side views showing states before and after the pressure is applied to the thermal head.

Referring to FIG. 1, a thermal head 101 is held on a printer body through a mounting member (not shown) with a freedom of movement (slightly movable back and forth and vertically). A rear plate 102 is arranged behind the thermal head 101. The rear plate 102 is supported on the printer body at the position of a fulcrum A shown in FIG. 2 through a shaft, so that it is rotatable about the fulcrum A.

As shown in FIG. 1, two through holes are formed in the rear plate 102 in the widthwise direction (right and left portions). A hat-shaped member **104*b* is fixed to the rear plate 102 to cover the left one of these through holes from above. A T-shaped movable member 105*b* and a spring 103*b* are arranged in the member 104*b* to constantly press the thermal head 101 downward. A hat-shaped member 104*a* having an opening on the upper surface is fixed to the rear plate 102 to cover the other through hole. A spring 103*a*, a spring retainer 106 and a T-shaped movable member 105*a* are arranged in the member 104*a***.

A shaft 109 is supported by a frame plate 107, fixed to the rear plate 102, through bearings **119*a* and 119*b*. Grooves are formed in portions of the shaft 109 on the outer sides of the bearings 119*a* and 119*b*, and E rings 120*a* and 120*b* are fixed to the shaft 109 such that the shaft 109 will not move in the horizontal direction. The shaft 109 is driven to rotate by a spring control stepping motor 111, which is also provided on the rear plate 102, through a belt 110. A spring control cam 108 is mounted on the shaft 109. The cam 108 presses the spring retainer 106 to control its position, thereby adjusting the spring pressure. The spring control cam 108 is divided into two portions so that it can stably press the spring retainer 106** at right and left portions.

A cam 112 for detecting the origin of a rotation angle is mounted on the shaft 109. When the cam 112 is rotated, an origin detection switch 113 fixed to the frame plate 107 through an L-shaped member 118 is turned on/off, thereby detecting the origin. Note that the spring pressure corresponding to this origin is equal to the spring pressure of the spring **103*b* used for the other movable member 105*b***.

Referring to FIG. 2, a shaft 115 is supported by the printer body, and is driven to rotate by a head lift DC motor (not shown) through a belt 124. Head lift cams **114*a* and 114*b* mounted on the shaft 115 press the rear plate 102 at the shortest points of the head lift cams 114*a* and 114*b* before pressure is applied to the head. As the head lift cams 114*a* and 114*b* are rotated, the rear plate 102 is moved about the fulcrum A as the center. When the head lift cams 114*a* and 114*b* press the rear plate 102 at the longest points of the head lift cams 114*a* and 114*b*, as shown in FIG. 3, the thermal head 101 presses a platen drum 121. As a result, an ink ribbon 125 and recording paper are sandwiched between the thermal head 101 and the platen drum 121 under pressure. Note that the rear plate 102 is supported such that it is always brought into contact with the head lift cams 114*a* and 114*b* with a spring pressure (not shown) supplied by the printer body. The shaft 115 is mounted with cams 116*a* and 116*b* whose phases of the longest points differ by 180° from each other, as shown in FIG. 1. When the cams 116*a* and 116*b* are rotated, they respectively turn on/off switches 117*a* and 117*b*, thereby detecting the vertical movement of the thermal head 101**.

Figure 4:
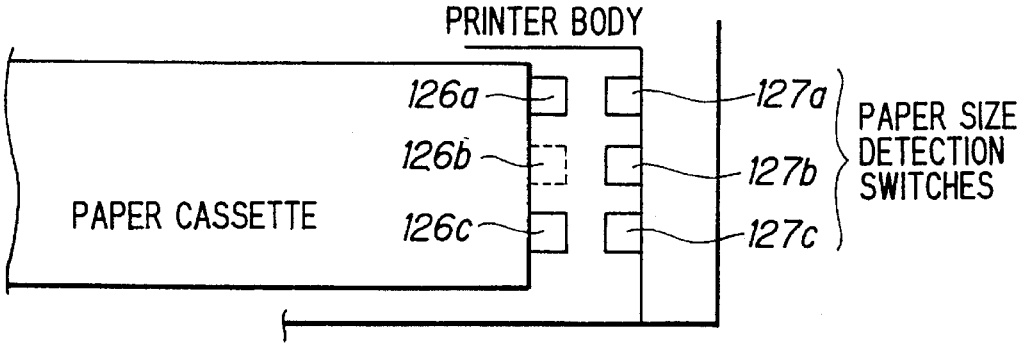
FIG. 4 is a detailed view showing a unit for detecting a paper size (recording paper size)

As shown in FIG. 4, three switch depressing members **126*a* to 126*c* are provided on a side surface of the paper cassette, and three paper size detection switches 127*a* to 127*c* are arranged on the side surface of the paper cassette inserting portion of the printer body to correspond to the positions of the switch depressing members 126*a* to 126*c*. When the switch depressing member of the paper cassette is set in accordance with the paper size and the paper cassette is inserted in the printer body, the paper size detection switches 127*a* to 127*c* are turned on/off, and the paper size is detected from the ON/OFF states of the paper size detection switches 127*a* to 127*c***.

Figure 5:
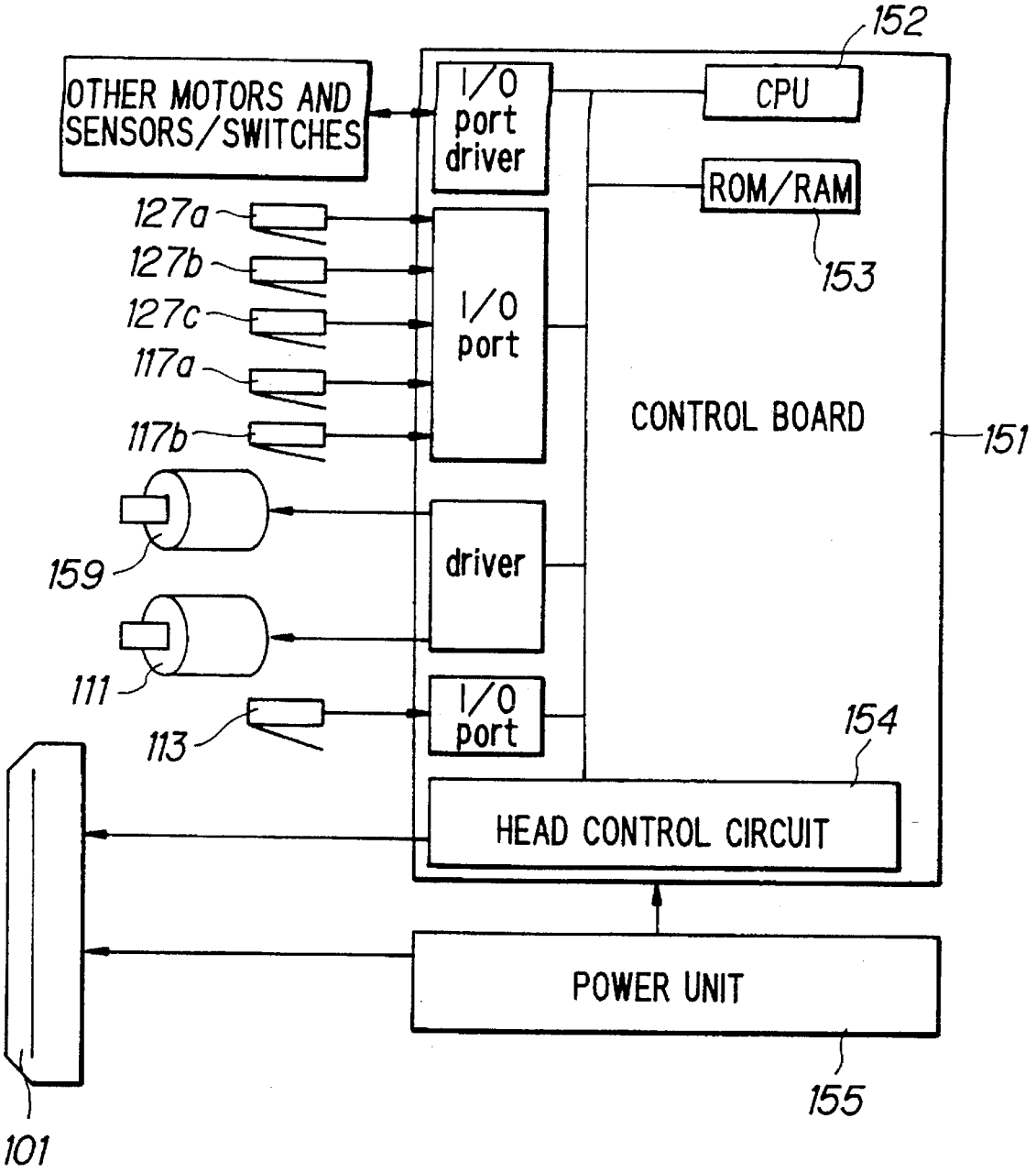
FIG. 5 is a block diagram showing a control circuit of the printer according to the present invention.

FIG. 5 is a block diagram showing a control circuit of the printer according to the present invention. The control circuit comprises a CPU 152 for performing various types of operations, a ROM/RAM 153 for storing a program/data, a head control circuit 154 for controlling the thermal head 101, and I/O ports for controlling various types of motors and detecting the states of the switches/sensors. Reference numeral 155 denotes a power unit; and 151, a control board.

As shown in FIG. 5, a head lift DC motor 159, the spring control stepping motor 111, and other motors are controlled by the CPU 152 through motor drivers. When the paper cassette is mounted in the printer body, either one of the paper size detection switches 127*a* to 127*c* is turned on. This state is read by the CPU 152 through the I/O port, so that the paper size is recognized. Of the switches 117*a* and 117*b* that detect the position of the thermal head 101, if the switch 117*a* is turned on, this indicates a state in which the thermal head 101 is pressed against the platen drum 121. If the switch 117*b* is turned on, a state wherein the thermal head 101 is separated from the platen drum 121 is recognized. The CPU 152 detects the origin position of the spring control cam 108 by reading the state of the origin detection switch 113 of the spring control motor.

Figure 6:
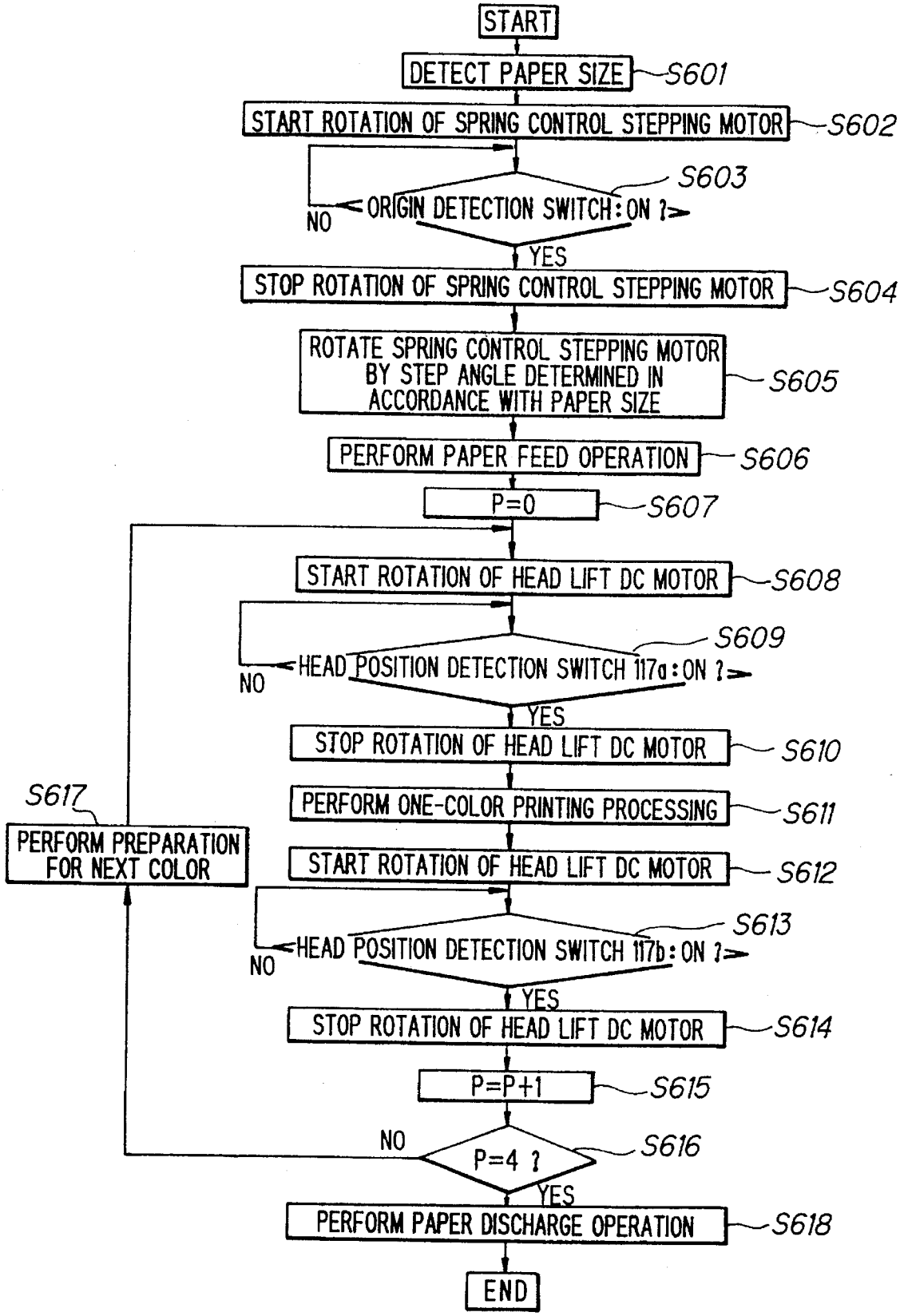
FIG. 6 is a flow chart showing the sequence of the printing operation of the printer according to the present invention.
Figure 7:
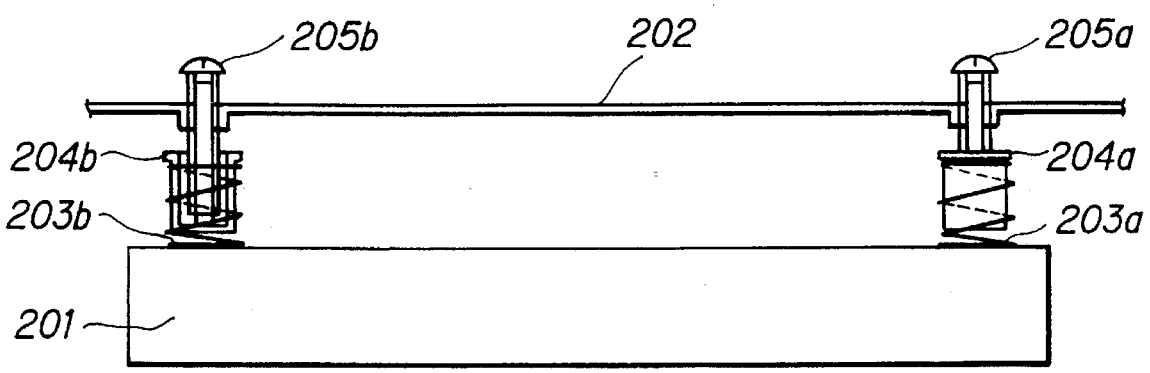
FIG. 7 PRIOR ART
FIG. 7 is a front view showing the head pressing mechanism of a conventional printer.
Figure 8:
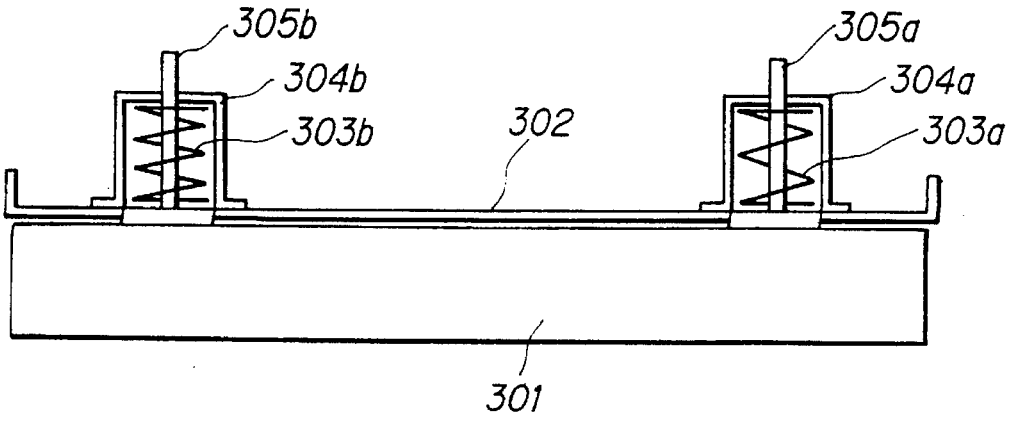
FIG. 8 PRIOR ART
FIG. 8 is a front view showing the head pressing mechanism of another conventional printer.
Figure 9:
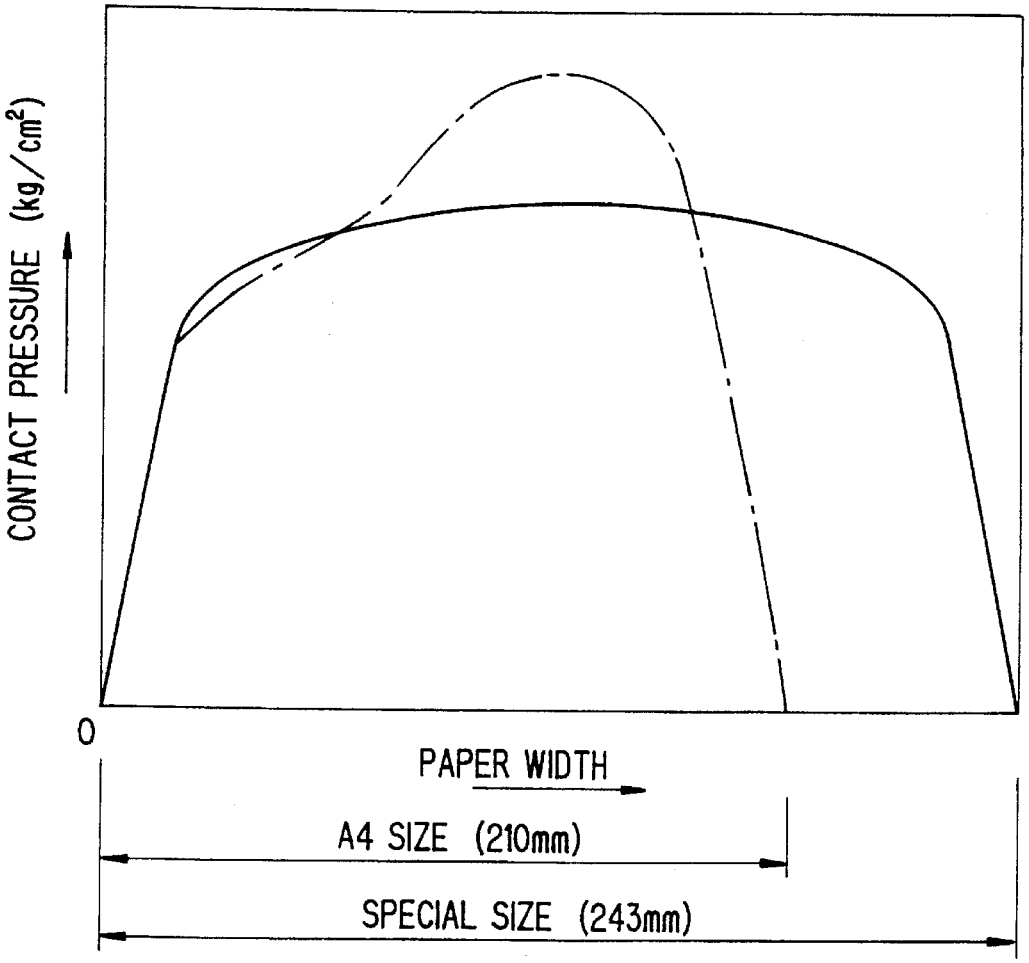
FIG. 9 is a graph showing a difference in pressure distribution depending on the difference of a paper size (recording paper size).

FIG. 6 is a flow chart of a case wherein a printing operation is performed using a four-color ribbon. When the printing operation is started, the CPU 152 reads the states of the three paper size detection switches 127*a* to 127*c*, and recognizes the recording paper size from them (S601). The CPU 152 then rotates the spring control stepping motor 111 in the forward direction. Upon start of the rotation, the CPU 152 constantly monitors the states of the origin detection switch 113 for the spring control stepping motor 111. When the switch 113 is turned on, the CPU 152 stops the spring control stepping motor 111 (S602 to S604). The CPU 152 then outputs the number of pulses set in the ROM/RAM 153 in accordance with the recording paper size, and rotates the spring control stepping motor 111 in the forward direction by a predetermined angle, thereby setting a spring pressure corresponding to the recording paper size. The number of pulses is determined by considering the size of the cam employed (S605).

Paper in the paper cassette is fed into the printer body (S606), and the printer starts a one-color printing operation. A parameter p indicating the ordinal color number in printing is set to 0 (S607), and thereafter the head lift DC motor 159 is rotated in the forward direction. At the same time, the head position detection switch 117*a* is monitored. When the switch 117*a* is turned on, rotation of the head lift DC motor 159 is stopped (S608 to S610). Thus, the thermal head 101 remains pressed against the platen drum 121. In this state, the one-color printing operation is performed by the operation of the head control circuit 154, the rotation of the platen drum 121, and the like. When the printing operation is ended, the head lift DC motor 159 is rotated in the forward direction. When the switch 117*b* is turned on, rotation of the head lift DC motor 159 is stopped (S611 to S614). Thus, the thermal head 101 remains separated from the platen drum 121.

Whether or not the four-color printing operations are ended is checked from the value of p. If YES, the flow advances to the printed paper discharge operation (S618). If NO, preparation for the printing operation of the subsequent color is performed, and the above processing is repeated (S615 to S617).

In the arrangement of this embodiment, the spring control motor, the origin detection switch, and the like are provided on the rear plate which is located behind the thermal head and which serves as the support member of the portion applying pressure to the head. This promotes reduction in component space. If the origin detection switch is fixed, the positional difference between the switch and the cam relative to each other can be decreased, so that the origin can be detected accurately.

Furthermore, in this embodiment, the rear plate is pressed by cams (head lift cams) which are supported by another member to move the head upward and downward, and the two cams provided separately on the shaft on which the head lift cams are mounted turn on two switches, respectively, thereby controlling the upward and downward movements of the head. As a result, the entire thermal head pressure-applying unit including the unit for automatically adjusting pressure applied to the thermal head can be easily pressed against and released from the platen drum, thereby realizing a desired printing operation correctly and quickly.

What is claimed is:

1. A printer comprising:

a thermal head for transferring ink of an ink ribbon onto recording paper by heat generation;

a platen drum for sandwiching the ink ribbon and the recording paper under pressure together with said thermal head;

adjusting means for adjusting pressure applied to said thermal head when pressing said thermal head;

detection means for detecting a size of the recording paper; and a control unit for controlling said adjusting means in order to adjust the pressure applied to said thermal head in accordance with the size of the recording paper detected by said detection means.

2. A printer according to claim 1, further comprising a cam driven to rotate by a pulse motor to move said adjusting means, wherein said control unit outputs a predetermined number of pulses in accordance with the size of the recording paper detected by said detection means, and controls a position of said adjusting means through said cam rotated at a predetermined angle by said pulse motor based on the number of pulses.

3. A printer according to claim 2, further comprising: a plurality of pressing means for pressing said thermal head; and origin detection means for detecting the origin which is defined as a rotation angle of said cam when the pressure of said adjusting means on said thermal head coincide with the pressure of the plurality of said pressing means on said thermal head, wherein said control unit stops driving said pulse motor when said origin detection means detects the origin.

4. A printer according to claim 3, wherein when said printer is not in use, said control unit outputs a predetermined number of pulses to control said pulse motor so that the rotation angle of said cam reaches the origin.

* * * * *